United States Patent [19]

Wheless

[11] Patent Number: 4,807,738

[45] Date of Patent: Feb. 28, 1989

[54] CONVEYOR APPARATUS

[75] Inventor: Jack C. Wheless, Richmond, Va.

[73] Assignee: Philip Morris Incorporated, New York, N.Y.

[21] Appl. No.: 107,690

[22] Filed: Oct. 13, 1987

[51] Int. Cl.[4] ..... B65G 17/32

[52] U.S. Cl. ..... 198/377; 198/408; 198/471.1; 198/476.1

[58] Field of Search ..... 198/375, 377, 378, 408, 198/409, 470.1, 471.1, 474.1, 475.1, 476.1, 802, 803.5, 951; 131/282, 283

[56] References Cited

U.S. PATENT DOCUMENTS

| | | | |
|---|---|---|---|
| 2,643,778 | 6/1953 | Socke | 214/1 |
| 3,215,250 | 11/1965 | Schubert | 198/33 |
| 3,314,518 | 4/1967 | Buttery et al. | 198/475.1 |
| 3,322,290 | 5/1967 | Ahlstedt | 214/62 |
| 3,670,866 | 6/1972 | Olivotto | 198/33 AC |
| 3,771,639 | 11/1973 | Giatti | 198/475.1 |
| 3,776,343 | 12/1973 | Gouy | 198/471.1 |
| 3,952,865 | 4/1976 | Rudszinat et al. | 198/240 |
| 3,973,671 | 8/1976 | Schwenke | 198/471.1 |
| 4,090,602 | 5/1978 | Schubert et al. | 198/377 |
| 4,211,318 | 7/1980 | Verjux | 198/377 |
| 4,372,436 | 2/1983 | Achelpohl et al. | 198/377 |
| 4,408,621 | 10/1983 | Schumacher | 131/282 |
| 4,465,083 | 8/1984 | Schumacher | 131/282 |
| 4,565,359 | 1/1986 | von Hein | 270/41 |
| 4,582,201 | 4/1986 | Taniguchi et al. | 209/587 |
| 4,586,598 | 5/1986 | Ehlscheid et al. | 198/356 |

*Primary Examiner*—Joseph E. Valenza
*Attorney, Agent, or Firm*—Robert R. Jackson

[57] ABSTRACT

Conveyor apparatus for changing the orientation and/or velocity of the objects being conveyed.

6 Claims, 4 Drawing Sheets

CONVEYOR APPARATUS

BACKGROUND OF THE INVENTION

This invention relates to conveyor apparatus, and more particularly to conveyor apparatus that is adapted for positively controlling the object or objects being conveyed, and for reorienting and/or altering the velocity of those objects during conveyance.

Although those skilled in the art will appreciate that this invention has many other possible applications, the invention will be fully understood from the following explanation of illustrative applications that occur in the making of cigarettes or cigarette-like smoking articles (hereinafter generically called cigarettes).

In a typical cigarette-making machine, the "maker" portion of the machine ejects lengthwise a substantially continuous tobacco-filled paper tube which has been cut transversely at regular intervals to form what will be the smokable portions of the cigarettes. These smokable portions are picked up one after another by the "tipper" portion of the machine which moves them sideways through several further processing steps (e.g., the steps that add a filter to one end of each smokable portion). In going from the maker to the tipper, the longitudinal motion of each smokable portion must be stopped and sideways motion commenced. Typically this is accomplished by a 90° change in the velocity vector of the smokable portion without changing the orientation of the smokable portion. It is difficult to achieve such a radical change in velocity in a reliable manner and without damaging or adversely affecting the smokable portions. For example, it is typical (1) to accelerate each smokable portion as it exits from the maker to create a gap between that smokable portion and the succeeding smokable portion, (2) to rely on inertia to carry the accelerated smokable portion into a groove in the drum which is the first stage of the tipper, (3) to abruptly stop the smokable portion once it is in the groove, and (4) to then cause the drum to rotate slightly to align the next groove for receipt of the next accelerated smokable portion from the maker. The apparatus typically employed for the foregoing does not positively control the smokable portions at all times, and subjects them to rapid acceleration (which is difficult to achieve in the absence of positive control) and rapid deceleration (which can adversely affect the smokable portions, e.g., by causing the tobacco to shift longitudinally relative to the surrounding paper tube).

In view of the foregoing, it is an object of this invention to provide improved conveyor apparatus.

It is a more particular object of this invention to provide conveyor apparatus which positively controls the object being conveyed and which can be used to reorient and/or change the velocity of that object.

SUMMARY OF THE INVENTION

These and other objects of the invention are accomplished in accordance with the principles of the invention by providing means for causing first and second supports to respectively traverse congruent paths in first and second planes which are parallel to one another but spaced from one another along a spacing axis perpendicular to those planes. Although the paths traversed by the supports are congruent, they are offset from one another along an offset axis perpendicular to the spacing axis. Movement of the supports is synchronized so that they remain at congruent points on their respective paths. Each support is constrained to maintain a constant orientation relative to the immediately adjacent portion of the associated path.

A conveyor member extends between the first and second supports and is pivotally connected to each support. In particular, each pivotal connection includes two intersecting pivotal axes: one which is perpendicular to the immediately adjacent portion of the associated path and parallel to the plane of that path, and a second which is mutually perpendicular to the first and to a line between the two supports. The conveyor member includes means for holding the object to be conveyed.

As a result of the foregoing structure, the object to be conveyed will be reoriented and/or subjected to a velocity change whenever the supports traverse an arcuate section of the paths. A wide range of reorientations and/or velocity changes can be achieved by appropriate selection of the variables that characterize the apparatus.

Further features of the invention, its nature and various advantages, will be more apparent from the accompanying drawings and the following detailed description of the invention.

DETAILED DESCRIPTION OF THE INVENTION

Figure 2:
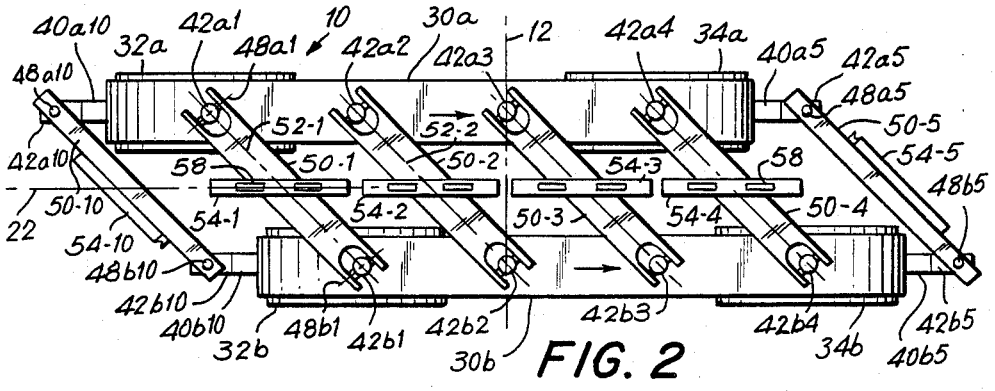
FIGS. 2 and 3 are views taken respectively along the lines 2—2 and 3—3 in FIG. 1.
Figure 1:
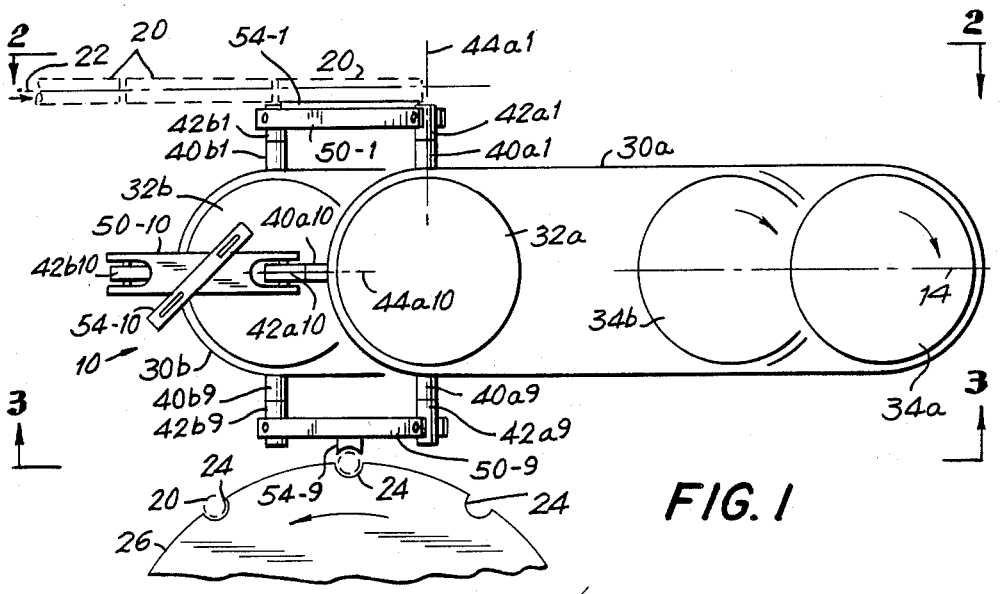
FIG. 1 is a simplified, partial, elevational view of illustrative conveyor apparatus constructed in accordance with the principles of the invention.
Figure 3:
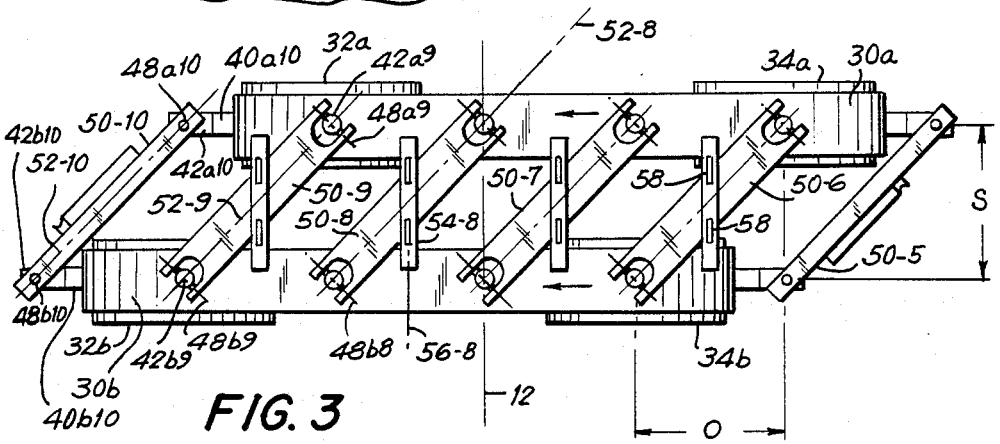

As shown in FIGS. 1–3, an illustrative application and embodiment of the conveyor apparatus 10 of this invention is adapted to receive the smokable portions 20 of cigarettes ejected longitudinally along axis 22 from the "maker" portion of a cigarette-making machine, and to reorient those smokable portions so that their longitudinal axes are parallel to but laterally spaced from one another as is desirable for further processing of the smokable portions in the "tipper" portion of the cigarette-making machine. In particular, the reoriented smokable portions are delivered one after another to the flutes 24 of a revolving drum 26 at the input of the tipper. (The maker and tipper are not shown herein, but may be entirely conventional.)

As viewed in FIG. 1, conveyor apparatus 10 includes forward conveyor belt **30*a* and rearward conveyor belt 30*b*. (It will be understood that terms like forward, rearward, left, right, upper, and lower are used herein in a relative rather than an absolute sense, and that conveyor apparatus 10 can have any desired orientation relative to the observer.) Conveyor belt 30*a* is supported and driven by drums 32*a* and 34*a*, while conveyor belt 30*b* is supported and driven by drums 32*b* and 34*b*. Both of belts 30 are driven in the same direction (clockwise as viewed in FIG. 1) at the same speed. The drive mechanism (not shown but entirely conventional) is preferably synchronized with the maker and the tipper. In order to ensure that belts 30 remain in synchronization with one another and with the remainder of the apparatus, the outer surfaces of drums 32 and 34 and the inner surfaces of belts 30 may have mating teeth similar to those employed with a conventional timing belt. The closed paths traversed by belts 30***a* and 30*b* as viewed in FIG. 1 are substantially identical to one another in size and shape. Accordingly, these paths are referred to for convenience herein as congruent, although they are offset from one another in a direction parallel to offset axis 14 as will be explained in more detail below.

The path traversed by belt 30*a* defines a first plane parallel to the plane of the paper in FIG. 1. The path traversed by belt 30*b* defines a second plane also parallel to the plane of the paper in FIG. 1. The above-mentioned parallel planes are spaced from one another along a spacing axis 12 which is perpendicular to both planes. Offset axis 14 is perpendicular to spacing axis 12 and is therefore parallel to the planes defined by the paths of belts 30. Although other alignments of offset axis 14 are possible, in the particular embodiment shown in FIGS. 1–3 offset axis 14 is aligned so that it intersects the axes of rotation of all of drums 32 and 34. Because the path traversed by each belt includes two parallel straight line segments joined to one another at both ends by convex outward semicircular arcuate sections, and because offset axis 14 intersects the axes of rotation of all of drums 32 and 34, offset axis 14 is also parallel to all of the above-mentioned straight line belt segments.

Each belt 30 carries a plurality of supports 40*a*1, 40*a*2, 40*a*3, . . . , 40*b*1, 40*b*2, 40*b*3, . . . , spaced evenly along the length of the belt. (For clarity and simplicity, only some of supports 40 and associated elements 42, 50, and 54 are shown n FIG. 1. The depictions in FIGS. 2 and 3 are more complete.) In the particular embodiment shown in FIGS. 1–3, supports 40 project radially outward from belts 30. The belts are initially arranged and thereafter synchronized with one another so that each of supports 40*a* is always at a point on the path traversed by belt 30*a* which is congruent to the point on the path traversed by belt 30*b* at which a respective one of supports 40*b* is located. For example, when support 40*a*1 is at the left-hand end of the upper straight line segment of belt 30*a* as shown in FIG. 1, associated support 40*b*1 is at the left-hand end of the upper straight line segment of belt 30*b*. Because belts 30*a* and 30*b* travel in the same direction at the same speed, supports 40*a*1 and 40*b*1 always remain at congruent points on the belt paths. The same is true of all other pairs of supports 40 (e.g., 40*a*2 and 40*b*2, 40*a*3 and 40*b*3, etc.).

A cylindrical member 42 is pivotally mounted on each of supports 40. The pivotal axis 44 of each such pivotal mounting is parallel to the plane in which the associated belt 30 runs and perpendicular to the immediately adjacent portion of the path traversed by that belt. Note that each support 40 is fixed relative to the associated belt 30 in such a way that the support always has the same orientation relative to the immediately adjacent portion of the associated belt.

A conveyor member 50 extends from each cylindrical member 42*a* to the associated one of cylindrical members 42*b*. For example, conveyor member 50-1 extends between cylindrical members 42*a*1 and 42*b*1, conveyor member 50-2 extends between cylindrical members 42*a*2 and 42*b*2, and so on around belts 30. Each conveyor member 50 is pivotally connected to each of the associated cylindrical members 42. The pivotal axis 48 of each such pivotal connection perpendicularly intersects the associated pivotal axis 44 and is also perpendicular to an axis 52 through the two cylindrical members 42 associated with the conveyor member. Each conveyor member 50 is substantially rigid and inflexible. Note that the lengths of all of conveyor members 50 are the same, and that the longitudinal axes 52 of all of conveyor members 50 are parallel to one another at all times.

In the particular embodiment shown in FIGS. 1–3, the spacing S along spacing axis 12 between the plane defined by pivotal axes 44*a* and the plane defined by pivotal axes 44*b* is equal to the offset O of belts 30*a* and 30*b* parallel to offset axis 14. As a result, each of conveyor members 50 (as characterized by its longitudinal axis 52) is inclined at an angle of 45° to both spacing axis 12 and offset axis 14 at all times.

A longitudinal carrier member 54 is fixedly mounted on each conveyor member 50. In the particular embodiment shown in FIGS. 1–3, the longitudinal axis 56 of each carrier member 54 forms an angle of 45° with the longitudinal axis 52 of the associated conveyor member 50. All of carrier members 54 are located at the same relative positions on the associated conveyor members 50. Each carrier member 54 is slightly shorter parallel to its longitudinal axis 56 than the spacing between adjacent supports 40*a* and 40*b*. As a result of the foregoing considerations, the longitudinal axes 56 of all of the carrier members 54 associated with the conveyor members 50 that are traversing one straight line segment of belts 30 (the side visible in FIG. 2) will be coaxial with one another and parallel to offset axis 14, while the longitudinal axes 56 of all of the carrier members 54 associated with the conveyor members 50 that are traversing the other straight line segment of belts 30 (the side visible in FIG. 3) will be parallel to one another and to spacing axis 12 but laterally spaced from one another. In particular, at the instant of time shown in FIGS. 1–3, carrier members 54-1, 54-2, 54-3, and 54-4 are coaxial with one another and parallel to offset axis 14, while carrier members 54-6, 54-7, 54-8, and 54-9 are parallel to one another and to spacing axis 12 but laterally spaced from one another (like the pickets of a picket fence). Carrier member 54-5, which is traversing one of the arcuate segments of the belt path, is reorienting from the above-mentioned coaxial orientation to the above-mentioned picket orientation. Carrier member 54-10, which is traversing the other arcuate segment of the belt path, is reorienting from the picket orientation to the coaxial orientation.

Each carrier member 54 is adapted to releasably retain one smokable portion 20. In particular, the outer surface of each carrier member 54 is concave to receive a portion of the convex outer surface of a smokable portion 20. Each carrier member 54 can be selectively supplied with vacuum to hold a smokable portion 20 to the carrier member as the carrier member travels from the depicted location of carrier member 54-1 (where each carrier member picks up a smokable portion 20 from the maker) to the depicted location of carrier member 54-9 (where each carrier member transfers its smokable portion 20 to tipper drum 26). The use of vacuum to assist in the conveyance of articles such as smokable portions 20 is conventional and extremely well known to those skilled in the art (especially the cigarette-making art) so that detailed depiction is not necessary. Suffice it to say that one possible way to supply vacuum to carrier members 54 is to provide a stationary vacuum plenum in the area bounded by each of belts 30 and in the plane defined by the associated pivotal axes 44. Vacuum is conveyed from each of these plenums through interconnected interior passages in belts 30, supports 40, cylindrical members 42, the axles aligned with axes 48, conveyor members 50, and carrier members 54, those passages finally opening out at 58 in the bottom of the concave surface of carrier members 54 so that smokable portions 20 will be held to carrier members 54 by the applied suction. To facilitate transfer of smokable portions 20 to drum 26 and to avoid wasting vacuum where it is not needed, the above-mentioned vacuum plenums terminate just prior to the depicted locations of supports **40*a*-9 and 40*b*9, and begin again at approximately the depicted locations of supports 40*a*1 and 40*b*1**.

To facilitate the above-described use of conveyor apparatus 10, the apparatus is located and oriented so that axis 22 (along which smokable portions 20 are ejected from the maker) is parallel and closely adjacent to the coaxial axes of the coaxially aligned support members 54. In addition, the spacing between supports **40*a* and 40*b* is equal to the length of smokable portions 20, each carrier member 54 is slightly shorter than a smokable portion 20, and conveyor apparatus 10 is synchronized with the maker so that each smokable portion 20 ejected from the maker is met and supported by one carrier member 54 which, at least along the straight line segments of the belts, travels at the same speed as the smokable portions are ejected from the maker. Drum 26 is also structured and synchronized so that a flute 24 arrives at the depicted location of carrier member 54-9** each time a carrier member delivers a smokable portion to that location.

It will be seen from the foregoing that conveyor apparatus 10 operates to reorient smokable portions 20 90° from longitudinal alignment with axis 22 to longitudinal alignment perpendicular to the plane of the paper in FIG. 1. Stated another way, conveyor apparatus 10 reorients smokable portions 20 90° from coaxial alignment along axis 22 to picket-like alignment on drum 26. This is accomplished by a smooth and continuous reorientation, without ever stopping the smokable portions and with positive control over the motion of the smokable portions at all times.

Figure 4:
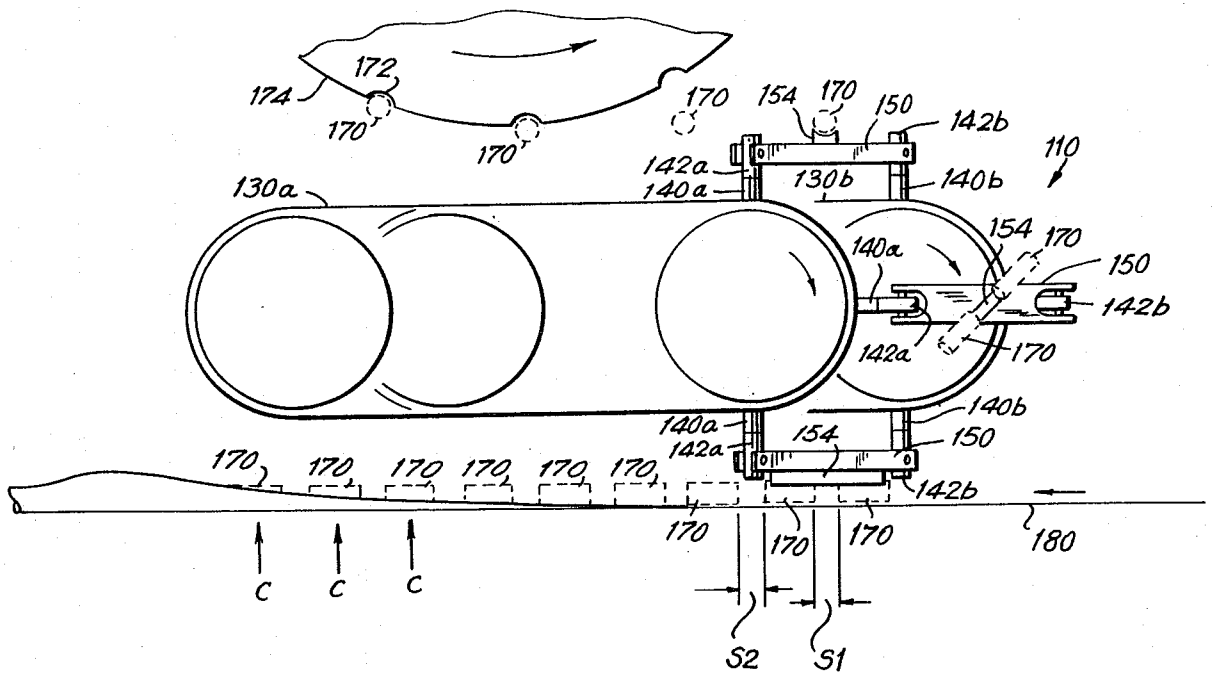
FIG. 4 is a view similar to FIG. 1 showing an alternative embodiment of the invention.

FIG. 4 illustrates another possible application of the conveyor apparatus of this invention. In FIG. 4 the conveyor apparatus 110 has been turned upside down from the orientation shown in FIG. 1. In other respects, conveyor apparatus 110 may be substantially similar to conveyor apparatus 10 and will therefore not be shown or described again in full detail. (Parts that are similar in FIGS. 1 and 4 have reference numbers that are increased by 100 in FIG. 4.)

Conveyor apparatus 110 is adapted for use in making composite filters for cigarettes. A typical composite filter has a longitudinal segment of charcoal granules sandwiched between two longitudinally spaced segments of cellulose acetate. Two coaxial, longitudinally spaced cylinders 170 of cellulose acetate are supplied in each flute 172 of supply drum 174. The longitudinal spacing S1 between cylinders 170 is the space to be filled with charcoal granules. At the bottom of drum 174 cylinders 170 are transferred to the conveyor apparatus carrier members 154, which on that side of the conveyor apparatus have the picket-like orientation described above in connection with FIGS. 1-3. As carrier members 154 traverse the arcuate right-hand end of the belt path, the carrier members reorient into coaxial alignment as is also described above in connection with FIGS. 1-3. The spacing of conveyor members 150 is such that, when cylinders 170 are coaxially aligned along the bottom of conveyor apparatus 110, the longitudinal spacing S2 between the adjacent ends of the cylinders 170 on adjacent carrier members 154 is equal to the longitudinal spacing S1 between the adjacent ends of the cylinders 170 on a given carrier member 154. Thus S2 is also the amount of space to be filled with charcoal granules.

Immediately below coaxially aligned cylinders 170 a continuous strip of plug wrap material 180 is supplied at the same speed as cylinders 170 are travelling. As cylinders 170 travel along above plug wrap 180, the plug wrap is gradually folded or deflected up around the cylinders by conventional and well-known means (not shown). As soon as cylinders 170 are sufficiently engaged by the plug wrap, they can be released from carrier members 154 by cutting off the vacuum supply to the carrier members at that point. At a convenient location before the plug wrap is completely closed around cylinders 170, charcoal granules are introduced into spaces S1 and S2 to completely fill those spaces. Then the closing of plug wrap 180 around cylinders 170 (and the interspersed charcoal segments) is completed. At another convenient location (probably downstream from the apparatus shown in FIG. 4) the continuous composite filter structure is cut at points like those indicated by arrows C to produce individual composite filters for individual cigarettes.

FIG. 4 illustrates the use of the apparatus of this invention to reorient workpieces 170 from a picket-like orientation (on the upper side of conveyor apparatus 110) to a coaxial orientation (on the lower side of apparatus 110). This is the reverse of the reorientation performed by the embodiment shown in FIGS. 1-3.

Although in the applications shown in FIGS. 1-4 the workpieces are both picked up and discharged along the straight line sides of the conveyor apparatus, workpieces can be picked up and discharged anywhere along the path of the apparatus, including either or both of the arcuate segments. The kind and amount of workpiece reorientation can be selected from a wide range of possibilities in this way. In this regard, it will also be noted that because carrier members 54 and 154 are spaced radially outward from belts 30, their velocity increases as they traverse the arcuate segments of the belt path. If carrier members 54 or 154 were instead set inside the belt path, their velocity would decrease as they traversed the arcuate segments of the belt path. In addition, pivots 42 (or 142) combined with pivots 48 (or 148) cause carrier members 54 (or 154) to rotate about a second axis as they traverse the accurate belt path segments. This further alters the velocity of the carrier members. These characteristics of the invention can be used to pick up and discharge workpieces at different velocities if desired.

Among the other ways to change the kind and amount of workpiece reorientation effected by the apparatus of this invention is to change one or more of the following characteristics of the apparatus: spacing dimension S; offset dimension O; the offset angle (given by the arctangent of S/O); the angle between axes 52 and 56 (which need not be 45° but can be any angle less than 90°, and which, in embodiments like FIGS. 1-3, produces an angular reorientation equal to twice this angle (e.g., in FIGS. 1-3 (2)(45°)=90°)); the direction of offset axis 14 relative to the straight line segments of the belt path (e.g., so that offset axis 14 is no longer parallel to those straight line segments); the distance from axis 48 to axis 56; the distance from axis 44 to the center of the associated carrier member 54; and the relative diameters of drums 32 and 34 (e.g., so that drums 34 are larger or smaller than drums 32).

Figure 5:
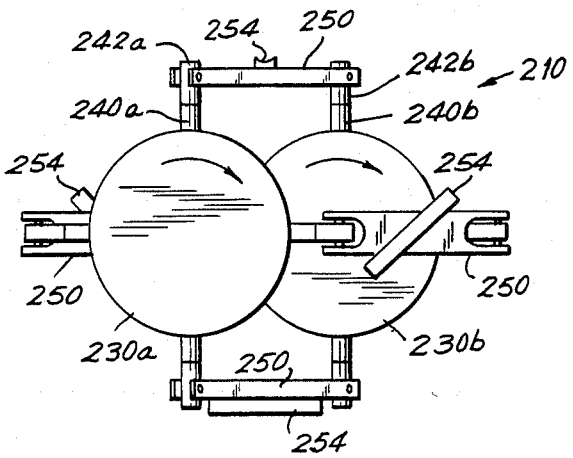
FIG. 5 is a view similar to FIGS. 1 and 4 showing another alternative embodiment of the invention.

The apparatus of this invention need not have the elongated shape shown in FIGS. 1–4. For example, FIG. 5 shows an alternative embodiment 210 in which conveyor members 250 are pivotally mounted between two rotating metal plates 230*a* and 230*b*. In most other respects, the embodiment of FIG. 5 is similar to the embodiments of FIGS. 1–4, and similar elements have reference numbers in FIG. 5 that are 100 more than in FIG. 4 and 200 more than in FIGS. 1–3.

Figure 6:
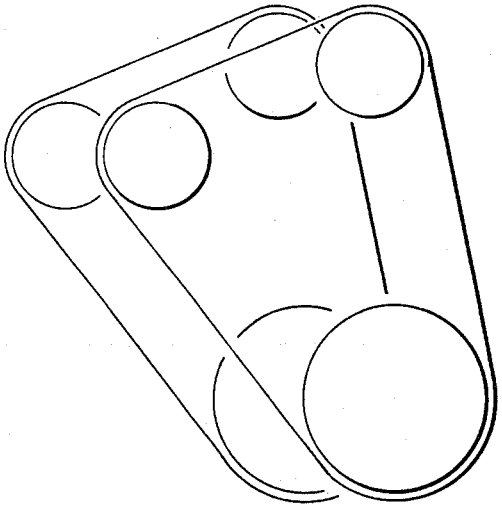
FIGS. 6–8 are simplified schematic views similar to FIGS. 1, 4, and 5 showing still other alternative embodiments of the invention.
Figure 7:
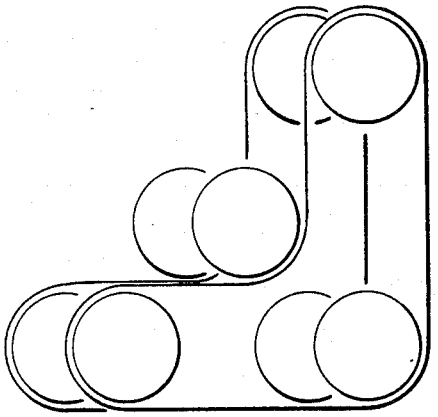
Figure 8:
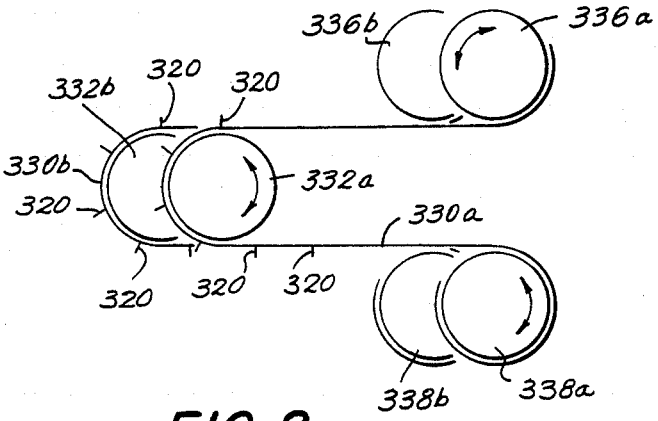

The paths traversed by the supports 40 can take many other shapes, only two of which are illustrated in FIGS. 6 and 7. The paths traversed by the supports need not be a closed path, but could instead be oscillatory (e.g., by driving the belts 30, 130, or plates 230 alternately in one direction and then in the other direction). FIG. 8 shows another embodiment in which supports 320 are driven in an oscillatory manner and the belts are finite rather than endless. In FIG. 8, the ends of belts 330 are attached to take-up drums 336 and 338 which are driven alternately clockwise and then counterclockwise in order to cause supports 320 to reciprocate back and forth around drums 332. (The end portions of belts 330 that wrap around drums 336 and 338 do not have supports 320.)

It will be understood that the foregoing is merely illustrative of the principles of the invention, and that various modifications can be implemented by those skilled in the art without departing from the scope and spirit of the invention. For example, any number of conveyor members can be spaced around plates 230 in the embodiment shown in FIG. 5 or along the belts in any of the other embodiments. Similarly, although vacuum has been described above for holding workpieces to conveyor members, other conventional and well-known means (e.g., spring clips, latches, etc.) can be alternatively employed.

I claim:

1. Conveyor apparatus for conveying successive longitudinal articles from a first straight line path segment to a second straight line path segment which is parallel to but spaced from said first straight line path segment along an axis which is perpendicular to said first and second straight line path segment, said longitudinal articles being longitudinally aligned with one another while on one of said straight line path segments and parallel to but laterally spaced from one another while on the other of said straight line path segments, said conveyor apparatus comprising:

a plurality of first supports;

first means for causing said first supports to sequentially traverse a first path disposed in a first plane parallel to the plane defined by said first and second straight line path segments, said first path including third and fourth straight line path segments respectively parallel to said first and second straight line path segments;

a plurality of second supports;

second means for causing said second supports to sequentially traverse a second path disposed in a second plane, said first and second planes being substantially parallel but spaced from one another along a spacing axis substantially perpendicular to said first and second planes, said second path including fifth and sixth straight line path segments respectively parallel to said first and second straight line path segments, said third and fifth straight line path segments defining a third plane which is substantially parallel to but spaced from a fourth plane defined by said fourth and sixth straight line path segments, said first and second paths being congruent to one another but offset from one another along an offset axis which is substantially perpendicular to said spacing axis and substantially parallel to said first and second straight line path segments, said first and second means being synchronized to maintain each of said first supports at a respective point on said first path which is congruent to the point on said second path at which a respective one of said second supports is located;

a plurality of longitudinal conveyor members, each of said conveyor members extending between a respective one of said first supports and the one of said second supports which is at the congruent point on said second path, the offset between said first and second paths being such that the longitudinal axis of each conveyor member forms an angle of approximately 45° with an axis parallel to said spacing axis;

first and second connector means associated with each conveyor member for respectively connecting the associated conveyor member to the first and second supports between which said conveyor member extends; and a plurality of longitudinal carrier members, each of said carrier members being mounted on a respective one of said conveyor members so that the longitudinal axis of each carrier member forms an angle of approximately 45° with the longitudinal axis of the associated conveyor member and so that when the supports for the associated conveyor member are on any of said third through sixth straight line path segments, the longitudinal axis of said carrier member is parallel to said third and fourth planes, all of said carrier members being mounted on their respective conveyor members at the same distance from said first plane so that the longitudinal axes of the carrier members on the portion of said conveyor apparatus adjacent said one of said first and second straight line path segments are longitudinally aligned with one another and so that the longitudinal axis of the carrier members on the portion of said conveyor apparatus adjacent said other of said first and second straight line path segments are parallel to but laterally spaced from one another, each of said carrier members being adapted to support at least one of said articles with the longitudinal axis of the article parallel to the longitudinal axis of said carrier member.

2. The apparatus defined in claim 1 wherein each of said first connector means includes first and second intersecting pivotal axes, said first pivotal axis being parallel to said first plane and perpendicular to the immediately adjacent portion of said first path, and said second pivotal axis being mutually perpendicular to said first pivotal axis and a line extending between said first and second connector means, and wherein each of said second connector means includes third and fourth intersecting pivotal axes, said third pivotal axis being parallel to said second plane and perpendicular to the immediately adjacent portion of said second path, and said fourth pivotal axis being mutually perpendicular to said third pivotal axis and said line extending between said first and second connector means.

3. The apparatus defined in claim 1 wherein each of said carrier members includes means for securing said at least one article to said carrier member.

4. The apparatus defined in claim 1 wherein each of said first and second paths includes at least one arcuate segment so that said at least one article conveyed by each carrier member is reoriented by said apparatus as said first and second supports associated with said carrier member traverse said arcuate segments.

5. The apparatus defined in claim 4 wherein the angle subtended by each of said arcuate segments is approximately 180°, and wherein each end of first and second paths includes first and second straight line each of said arcuate segments is tangent to a respective one of the straight line path segments of the associated one of said first and second paths.

6. The apparatus defined in claim 1 wherein the spacing between said conveyor members is such that, when said longitudinal axes of said articles are longitudinally aligned with one another, the ends of adjacent articles are immediately adjacent to one another.

* * * * *

UNITED STATES PATENT AND TRADEMARK OFFICE

CERTIFICATE OF CORRECTION

PATENT NO. : 4,807,738

DATED : February 28, 1989

INVENTOR(S) : Jack C. Wheless

It is certified that error appears in the above-identified patent and that said Letters Patent is hereby corrected as shown below:

| Column | Line | |
|---|---|---|
| 3 | 35 | Change "n" to --in--. |
| 5 | 14 | Change "40a-9" to --40a9--. |
| 10 | 5 | Delete "first and second". |
| 10 | 6 | Delete "paths include first and second straight line". |

Signed and Sealed this

Ninth Day of July, 1991

*Attest:*

*Attesting Officer*

HARRY F. MANBECK, JR.

*Commissioner of Patents and Trademarks*